US008327483B1

(12) United States Patent
Zamora et al.

(10) Patent No.: US 8,327,483 B1
(45) Date of Patent: Dec. 11, 2012

(54) FOLDABLE PILLOW

(75) Inventors: Javier Zamora, Antioch, IL (US); Edward Ray Howard, Jr., Dallas, TX (US)

(73) Assignee: Encompass Group, LLC, McDonough, GA (US)

( * ) Notice: Subject to any disclaimer, the term of this patent is extended or adjusted under 35 U.S.C. 154(b) by 0 days.

(21) Appl. No.: 13/235,921

(22) Filed: Sep. 19, 2011

(51) Int. Cl.
*A47G 9/10* (2006.01)

(52) U.S. Cl. ..... 5/636; 5/640

(58) Field of Classification Search ..... 5/636, 639, 5/640, 645, 490
See application file for complete search history.

(56) References Cited

U.S. PATENT DOCUMENTS

| | | | | |
|---|---|---|---|---|
| 395,043 | A | 12/1888 | Doremus | |
| 1,386,652 | A | 8/1921 | Patton | |
| 3,604,026 | A | 9/1971 | Schelps | |
| D282,036 | S | 1/1986 | Ritchie, Jr. et al. | |
| 5,044,026 | A | 9/1991 | Matthews | |
| 5,070,558 | A | 12/1991 | Fenley | |
| 5,228,158 | A * | 7/1993 | Park | 5/636 |
| 5,528,784 | A | 6/1996 | Painter | |
| 5,652,983 | A * | 8/1997 | Kraemer | 5/639 |
| D428,295 | S | 7/2000 | Frye | |
| 6,182,311 | B1 | 2/2001 | Buchanan et al. | |
| 6,601,252 | B1 | 8/2003 | Leach | |
| D487,207 | S | 3/2004 | Manuel | |
| 6,708,355 | B1 * | 3/2004 | Wang et al. | 5/644 |
| 6,928,675 | B2 | 8/2005 | Hamilton | |
| 7,055,197 | B1 | 6/2006 | Fathali | |
| 7,430,774 | B2 | 10/2008 | Littlehorn et al. | |
| 7,578,014 | B1 * | 8/2009 | Rodriguez | 5/636 |
| 7,627,916 | B1 | 12/2009 | Gielow | |

* cited by examiner

*Primary Examiner* — Michael Trettel
(74) *Attorney, Agent, or Firm* — Baker Donelson; Dorian B. Kennedy

(57) ABSTRACT

A foldable pillow (10) is disclosed having a pillow base (11) and a flexible strap (12) coupled to and spanning the pillow base. The pillow base is generally rectangular in shape having a top surface layer (14) and a bottom surface layer (15) which form an outer covering. The pillow strap is coupled to the pillow base closer to one end side (18) than the other end side. In use, the pillow may be folded and maintained in a folded configuration by tucking one end of the pillow below the strap.

7 Claims, 2 Drawing Sheets

FOLDABLE PILLOW

TECHNICAL FIELD

This invention relates to pillows, and particularly pillows which may be folded to reconfigure the pillow.

BACKGROUND OF THE INVENTION

Pillows have existed for centuries. The typical pillow is rectangular in shape and is generally uniform in thickness. People oftentimes fold these pillows in order to increase the thickness of the pillow, such as when one folds a pillow and places it behind one's back in order to sit more upright upon a bed.

In the medical field, nurses or other medical personnel also fold pillows so that one pillow may have a variety of heights or thicknesses. A nurse may reconfigure a pillow in this manner to increase the elevation of an underlying limb or to prop a patient in a certain area or manner. The problem associated with folding pillows is that they do not tend to stay folded, this being especially true when constant pressure is not applied to the pillow.

Accordingly, it is seen that a need remains for a foldable pillow that remains in a folded configuration. It is to the provision of such therefore that the present invention is primarily directed.

SUMMARY OF THE INVENTION

In a preferred form of the invention a pillow comprises a rectangular pillow base having a top surface, a bottom surface, two oppositely disposed longitudinal length sides, two oppositely disposed width sides, and at least one flexible strap. The strap extends at least partially across said top surface of the pillow base and is centrally offset so that the strap is closer to one width side than the other width side. With this construction, the pillow base can be folded so that a portion of the pillow is positioned beneath the strap to hold the portion in a folded configuration.

In another preferred form of the invention a method of folding and maintaining a pillow in a folded condition, comprises the steps of providing a pillow having a pillow base and a pillow strap coupled to the pillow base and extending across a top surface of the pillow base, manually folding the pillow base to form a folded portion and a remaining portion, and positioning the folded portion of the pillow base between the strap and the remaining portion of the pillow base to maintain the position of the folded portion relative to the remaining portion.

DETAILED DESCRIPTION

Figure 1:
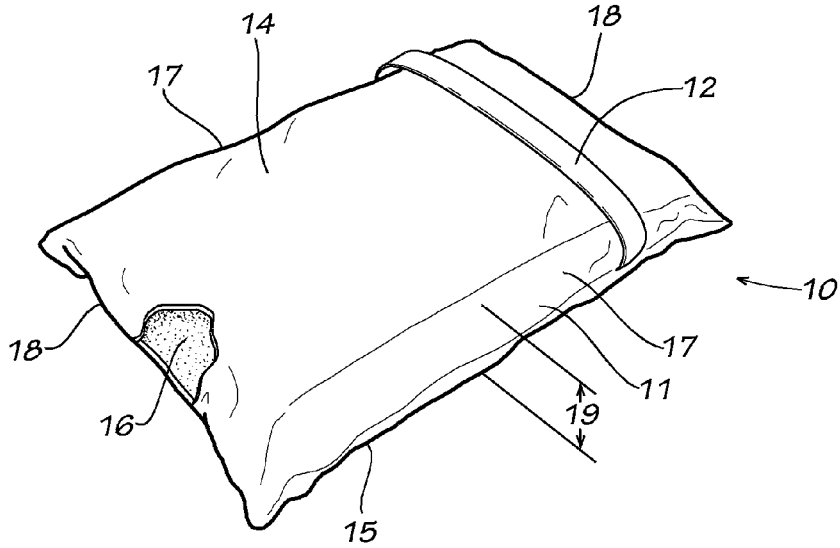
FIG. 1 is a perspective view of a foldable pillow embodying principles of the invention in a preferred form, shown in a non-folded configuration.
Figure 2:
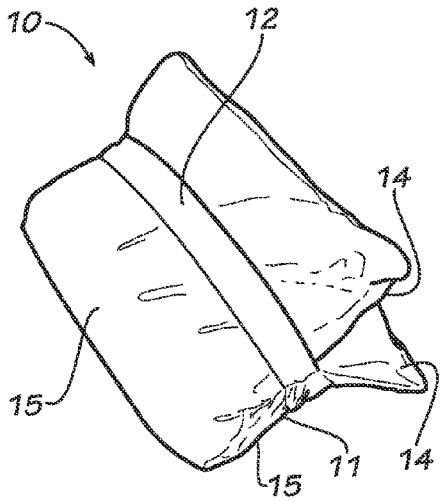
FIG. 2 is a perspective view of the foldable pillow of FIG. 1, shown in a folded configuration.

With reference next to the drawings, there is shown in FIGS. 1 and 2 a foldable pillow 10 in a preferred form of the invention. The pillow 10 has a pillow body or base 11 and a flexible, fabric holding strap 12 coupled to and spanning the pillow base 11. The pillow base 11 is generally rectangular in shape having a top surface layer 14 and a bottom surface layer 15 which form an outer covering. The pillow base 11 also has an inner core or batting 16 surrounded by the outer covering. The top and bottom surface layers 14 and 15 are joined at their peripheral edges to form two opposing longitudinally oriented length sides 17, two opposing end or width sides 18, and a select depth 19. The term rectangular used herein is intended to denote the general shape of the pillow as the pillow being made of a flexible material is not perfectly rectangular and the depth varies as the peripheral edges of the pillow are gathered. The terms top and bottom as used herein can be used interchangeably.

The pillow strap 12 is coupled at its ends to the length side 17 of the pillow base 11 closer to one end side 18 than the other end side 18, i.e., the strap is coupled longitudinally off center. Preferably, the strap 12 is mounted close to or adjacent one end side 18 of the pillow base.

In use, with the pillow 10 in an unfolded configuration, as shown in FIG. 1, the pillow may be utilized in the conventional manner. However, the pillow may also be folded upon itself and the end side 18 opposite or farthest the strap 12 is tucked beneath the strap 12 so that the pillow is folded in half and thereby maintained in a folded configuration by the strap, as shown in FIG. 2. With the pillow 10 in this folded configuration with the folded portion folded upon the remaining portion, the pillow is twice as thick or deep, thereby enabling it to maintain a person's body or body part in a higher or more elevated position. The pillow is unfolded by simply reversing the just described process.

Figure 3:
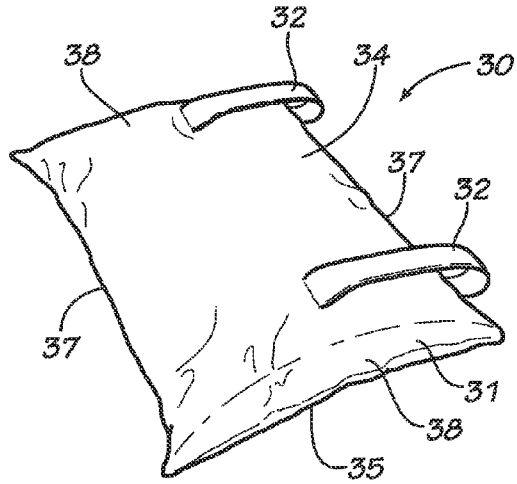
FIG. 3 is a perspective view of a foldable pillow embodying principles of the invention in another preferred form, shown in a non-folded configuration.
Figure 4:
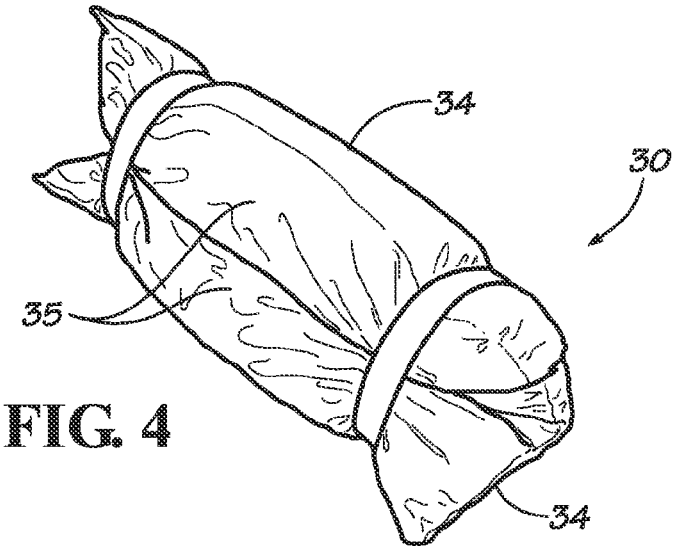
FIG. 4 is a perspective view of the foldable pillow of FIG. 3, shown in a folded configuration.

With reference next to FIGS. 3 and 4, there is shown a foldable pillow 30 in another preferred form of the invention. The pillow 30 has a pillow body or base 31 and two flexible, fabric holding straps 32 coupled to the pillow base 31. The pillow base 31 is generally rectangular in shape having a top surface layer 34 and a bottom surface layer 35 which form an outer covering. The pillow base 31 also has an inner core or batting surrounded by the outer covering. The top and bottom surface layers 34 and 35 are joined at their peripheral edges to form two opposing longitudinally oriented length sides 37, two opposing end or width sides 38, and a select depth. The term rectangular used herein is intended to denote the general shape of the pillow as the pillow being made of a flexible material is not perfectly rectangular and the depth varies as the peripheral edges of the pillow are gathered. The terms top and bottom as used herein can be used interchangeably.

Each pillow strap 32 is coupled at one of its ends to the length side 37 of the pillow base and at its opposite end to the top surface 14 approximately half way along the width of the pillow. Each strap 32 is mounted to the pillow base 31 closer to one end side 38 than the other end side 38, i.e., the straps are coupled longitudinally off center. Preferably, each strap 32 is mounted close to or adjacent one end side 38 of the pillow base so that each end side 38 has a strap adjacent thereto.

In use, with the pillow 30 in an unfolded configuration, as shown in FIG. 3, the pillow may be utilized in the conventional manner. However, the pillow may also be folded backwards upon itself so that the top surface layer 14 is facing outwards and the bottom surface layer 15 is folded to overlay itself. Each strap 32 is then brought around the adjacent folded end side 18 so that the folded portion or half of the pillow which does not have the initially overlaying strap is tucked below the strap so that it is captured by the strap and thereby maintained in a folded configuration, as shown in FIG. 4. With the pillow 30 in this folded configuration, the pillow is twice as thick or deep and the length side remains the same length, thereby enabling it to maintain a person's body or body part in a higher or more elevated position. The pillow is unfolded by simply reversing the just described process.

Figure 5:
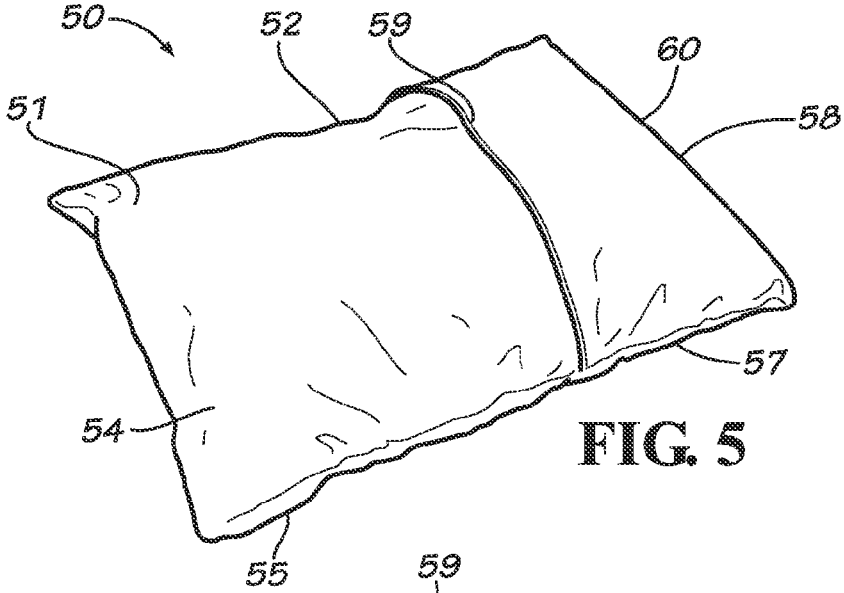
FIG. 5 is a perspective view of a foldable pillow embodying principles of the invention in another preferred form, shown in a non-folded configuration.
Figure 6:
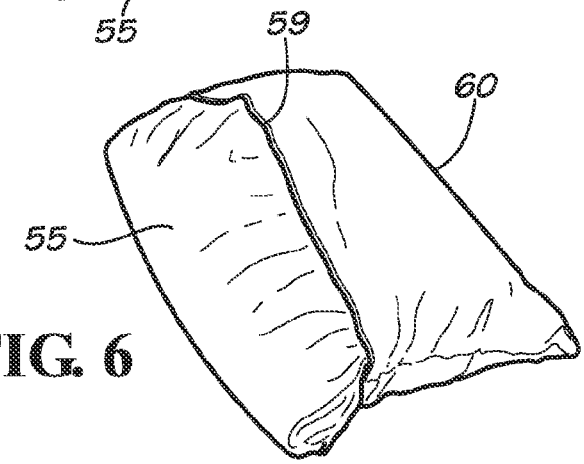
FIG. 6 is a perspective view of the foldable pillow of FIG. 5, shown in a folded configuration.

With reference next to the drawings, there is shown in FIGS. 5 and 6, a foldable pillow 50 in yet another preferred form of the invention. The pillow 50 has a pillow body or base 51 and a flexible, fabric holding strap 52 coupled to the pillow base 51 in the form of an open pocket. The pillow base 51 is generally rectangular in shape having a top surface layer 54 and a bottom surface layer 55 which form an outer covering. The pillow base 51 also has an inner core or batting 56 surrounded by the outer covering. The top and bottom surface layers 54 and 55 are joined at their peripheral edges to form two opposing longitudinally oriented length sides 57, two opposing end or width sides 58, and a select depth 59. The term rectangular used herein is intended to denote the general shape of the pillow as the pillow being of flexible material is not perfectly rectangular and the depth varies as the peripheral edges of the pillow are gathered. The terms top and bottom as used herein can be used interchangeably.

The pillow strap/pocket 52 is coupled at its side ends to the length side 57 of the pillow base 51 closer to one end side 58 than the other end side 58, i.e., the strap is coupled longitudinally off center. The strap/pocket 52 extends from an open end 59 approximately the longitudinal midpoint of the pillow base to a closed end 60 at the end side 58.

In use, with the pillow 50 in an unfolded configuration, as shown in FIG. 5, the pillow may be utilized in the conventional manner. However, the pillow may also be folded upon itself and the end side 58 opposite the strap/pocket 52 (the folded portion) is tucked beneath and into the strap/pocket 52 so that the pillow is folded in half and thereby maintained in a folded configuration, as shown in FIG. 6. With the pillow 50 in this folded configuration, the pillow is twice as thick or deep, thereby enabling it to maintain a person's body or body part in a higher or more elevated position. The pillow is unfolded by simply reversing the just described process.

It should be understood that the strap may extend lengthwise. Also, it should be understood that the pillow may also be fitted with the strap of the embodiment of FIGS. 1 and 2 and also with at least one of the straps of the embodiment of FIGS. 3 and 4. This multi-strap embodiment would allow the pillow to be folded either lengthwise and widthwise depending upon the needs at hand. Lastly, it should be understood that the term top or top surface as used herein is intended to refer to one of the large surface areas of the pillow, which may be either the top surface or the bottom surface depending upon the orientation of the pillow in the drawings, i.e., the top surface may also be a bottom surface, or visa-versa, if simply inverted.

It thus is seen that a pillow is now provided which may be folded and remain in a folded condition. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A pillow comprising, a rectangular pillow base having a top surface, a bottom surface, two oppositely disposed longitudinal length sides, and two oppositely disposed width sides, and two flexible straps that are longitudinally offset from each other, said strap extending at least partially across said top surface of said pillow base and each being centrally offset so that each said strap is closer to one said width side than the other said width side, whereby the pillow base can be folded so that a portion of the pillow is positioned beneath the strap to hold the portion in a folded configuration.

2. The pillow of claim 1 further comprising a third flexible strap extending from one said width side to the other said width side.

3. A pillow comprising, a foldable pillow base having a first surface, a second surface, a first end, and a second end;

a first flexible strap spanning one said pillow surfaces and being coupled to said pillow base closer to one said end than another said end, said first flexible strap being sized and shaped to hold a folded portion of said pillow base between the strap and said pillow base, a second flexible strap mounted to said pillow base closer to said other said end than to said one end, whereby the pillow base can be folded so that a portion of the pillow is positioned beneath the first strap to hold the portion in a folded configuration.

4. The pillow of claim 3 wherein said first and second flexible straps span only a portion of said first surface of said pillow base.

5. The pillow of claim 3 further comprising a third flexible strap extending from one said end to the other said end.

6. A method of folding and maintaining a pillow in a folded condition, comprising the steps of:

providing a pillow having a pillow base, a first flexible strap coupled to the pillow base and extending across a top surface of the pillow base, and a second flexible strap mounted to said pillow base and wherein the folded portion of the pillow is also positioned between the second flexible strap and the pillow base, manually folding the pillow base to form a folded portion and a remaining portion;

positioning the folded portion of the pillow base between at least one of the flexible straps and the remaining portion of the pillow base to maintain the position of the folded portion relative to the remaining portion.

7. The method of claim 6 wherein the pillow includes a third flexible strap extending across said pillow base.

* * * * *